US007832030B2

(12) United States Patent
Nunez et al.

(10) Patent No.: US 7,832,030 B2
(45) Date of Patent: Nov. 16, 2010

(54) TOILET BOWL SELF-CLEANER

(76) Inventors: Bolivar Nunez, 2101 S. Bristol St., Santa Ana, CA (US) 92704; Isabel Chavez, 3721 S. Timber, Santa Ana, CA (US) 92707

( * ) Notice: Subject to any disclaimer, the term of this patent is extended or adjusted under 35 U.S.C. 154(b) by 740 days.

(21) Appl. No.: 11/840,902

(22) Filed: Aug. 17, 2007

(65) Prior Publication Data

US 2009/0044322 A1 Feb. 19, 2009

(51) Int. Cl.
*A47K 17/00* (2006.01)

(52) U.S. Cl. ..... 4/661; 4/300; 4/348; 4/420

(58) Field of Classification Search ..... 4/233, 4/237, 239, 300, 348, 420, 661; 15/21.1, 15/56, 88.4, 246, 246.5
See application file for complete search history.

(56) References Cited

U.S. PATENT DOCUMENTS 3,199,739 A * 8/1965 Corning et al. ..... 4/661
3,837,018 A * 9/1974 Haberle ..... 4/233
4,217,671 A * 8/1980 Rand ..... 15/24
4,978,447 A * 12/1990 Hall ..... 15/246.5
5,806,105 A * 9/1998 Yu ..... 4/233
6,022,475 A * 2/2000 Thomas, III ..... 15/246.5
6,073,779 A * 6/2000 Shea et al. ..... 210/527
6,944,904 B1 * 9/2005 Williams ..... 401/139
2010/0011492 A1 * 1/2010 Sawalski et al. ..... 4/223
2010/0132137 A1 * 6/2010 Eggleston ..... 15/21.1

* cited by examiner

*Primary Examiner*—Khoa D Huynh
(74) *Attorney, Agent, or Firm*—John D. Tran; Ardent Law Group

(57) ABSTRACT

A motorized toilet bowl cleaning device includes a main body having a frame that attaches to a rim of a toilet bowl; a container coupled to the main body capable of holding a cleaning solution; a dispenser coupled to the container to spray the cleaning solution; an electric motor coupled to the main body; at least one brushing arm attached to the main body, a power source for powering the electric motor; and at least one moving wheel driven by a motor such that when the main body is attached to the rim, the wheel is in engaging contact with a surface of the rim. The dispenser is positioned and angled in a manner to spray the cleaning solution onto an inside wall of the toilet bowl.

11 Claims, 6 Drawing Sheets

TOILET BOWL SELF-CLEANER

BACKGROUND OF THE INVENTION (1) Field of the Invention

The field of the invention is related to automated cleaning systems for toilets. In particular, the invention relates to a motorized self-cleaning device for toilets that is portable.

(2) Description of Related Art Including Information Disclosed under 37 CFR 1.97 and 1.98

During routine use, toilet bowls become dirty and unsanitary without continued and periodic cleaning. It can be appreciated that there exist a variety of ways to clean the inner portions of a toilet bowl using such as things as flushing water containing sediments or dissolving minerals or applying cleaning solutions or powder directly to the toilet bowl followed by manual brushing and rinsing. Although flushing cleaning sediments or solutions can be effective for a general cleaning, this type of toilet cleaning often fails to effectively clean the tough soiled areas. In contrast, although manual brushing and cleaning with solutions and/or powders often can effectively clean the tough soiled areas, this task is generally regarded as unpleasant and time consuming.

Hence those concerned with the art have recognized that it would be advantageous to be able to routinely clean the inside of toilets in a manner that would avoid the unpleasant and time consuming need to manually brush and dispense cleaning solutions. It has been recognized that it would be highly desirable to limit or avoid entirely the need of direct human contact with potentially hazardous and acidic cleaning solutions and with disease contaminated surfaces such as the inner portions of toilets.

All referenced patents, applications and literatures are incorporated herein by reference in their entirety. Furthermore, where a definition or use of a term in a reference, which is incorporated by reference herein is inconsistent or contrary to the definition of that term provided herein, the definition of that term provided herein applies and the definition of that term in the reference does not apply. The invention may seek to satisfy one or more of the above-mentioned desire. Although the present invention may obviate one or more of the above-mentioned desires, it should be understood that some aspects of the invention might not necessarily obviate them.

In these respects, the motorized toilet bowl cleaner according to the present invention substantially departs from the conventional concepts and designs of the prior art, and in so doing provides a storage system that is not anticipated, rendered obvious, suggested, or even implied by any of the prior art storage systems either alone or in combination thereof.

BRIEF SUMMARY OF THE INVENTION

In view of the foregoing disadvantages inherent in the known types of toilet bowl cleaning devices and means now present in the prior art, the general purpose of the present invention, which will be described subsequently in greater detail, is to provide a motorized toilet bowl cleaning device that automatically dispenses cleaning solutions and manually brushes the inside of the toilet bowl.

Another object of the present invention is to provide an automatic motorized toilet bowl cleaning device that is portable and simple to operate;

Another object of the present invention is to provide an automatic motorized toilet bowl cleaning device that can be manually turned on or off;

Another object of the present invention is to provide an automatic motorized toilet bowl cleaning device that is refillable with cleaning solution;

Another object of the present invention is to provide an automatic motorized toilet bowl cleaning device that is adjustable to attach the rims of toilet bowls in various sizes;

Another object of the present invention is to provide an automatic motorized toilet bowl cleaning device that is battery powered;

Another object of the present invention is to provide an automatic motorized toilet bowl cleaning device that contains brushes that are replaceable;

Another object of the present invention is to provide an automatic motorized toilet bowl cleaning device that contains at least one moving wheel driven by an electric motor;

Another object of the present invention is to provide an automatic motorized toilet bowl cleaning device that contains a first sensor that detects when the toilet seat is lowered or raised, causing the present invention's motor to turn on or off;

Another object of the present invention is to provide an automatic motorized toilet bowl cleaning device that contains a second sensor for sensing a stopping point to cause the motor to shut off;

Another object of the present invention is to provide an automatic motorized toilet bowl cleaning device that contains a means for setting a pre-determined amount of passes that the motorized toilet bowl cleaner travels along the rim of the toilet bowl;

Another object of the present invention is to provide an automatic motorized toilet bowl cleaning device that contains a dispenser that can automatically spray a pre-determined amount of cleaning solution;

To attain this, the present invention in one embodiment generally comprises of a main body having a frame that attaches to a rim of a toilet bowl; a container coupled to the main body capable of holding a cleaning solution; a dispenser coupled to the container to spray the cleaning solution; an electric motor coupled to the main body; at least one brushing arm attached to the main body, a power source for powering the electric motor; and at least one moving wheel driven by a motor such that when the main body is attached to the rim, the wheel is in engaging contact with a surface of the rim. The dispenser is positioned and angled in a manner to spray the cleaning solution onto an inside wall of the toilet bowl. Further, the present invention contains a first and second sensor that could detect when to turn on and off the motor of the present invention thereby starting or stopping the present invention from moving along the along the length of the rim and the automatic movements of the brushing arm(s). In addition, the present invention contains a switch to determine cleaning solution operating modes which can control the amount cleaning solution is dispensed at any given time.

In typical use, the toilet seat is lifted up and the present invention is attached to the rim of the toilet bowl. In one contemplated embodiment, if operation is desired, the present invention would be positioned onto the toilet bowl rim and the toilet seat would be lowered as normal and the present invention would be turned on by its power switch. Upon lifting of the toilet seat, the first sensor of the present invention would detect such movement and initiate the motor to turn on and drive at least one moving wheel which allows the present device to move along the length of the rim at a pre-determined speed. At a pre-determined rate, the dispenser which is attached to the refillable container of cleaning solution will dispense the cleaning solution. The present embodiment utilizes a spray type of dispensing to cover more surface area of the inner toilet bowl, however, it can be appreciated that the dispensing of the cleaning solution may be in another spray form such as a stream or mist. Further, the motor will also drive at least one brushing arm that will automatically perform a brushing motion onto at least one inner wall of the toilet bowl. A second sensor on the present invention will determine the number of passes that the present invention travels along the length of the toilet rim. After the last pass, the second sensor will be able to prevent the present invention from moving further along the toilet bowl rim by automatically shutting down the motor.

Another contemplated embodiment includes a toilet bowl cleaning device, comprising: a housing having a space to hold cleaning solution; at least one nozzle coupled to the housing to spray cleaning solution; attachment means for attaching the housing to a rim of a toilet bowl, such that the nozzle is positioned within the toilet bowl; wherein the spraying is driven by at least one of electric pump, pressurized gas, and pressurized liquid. The present invention, further comprising a sensor to determine the time for actuating the nozzle to begin spraying, wherein the sensor is at least one member is selected the group consisting of motion sensor, mechanical sensor, pressure sensor, and temperature sensor. The present invention, further comprising a user-actuated switch allowing a user to selectively activate the nozzle for spraying cleaning solution onto an inner wall of the toilet bowl. The present invention, further comprising an electric circuit that turns on the nozzle at pre-determined time intervals. The present invention, further comprising a motor electrically powered to automatically move the device along the rim of the toilet bowl, wherein the motor is coupled to at least one rubberized wheel disposed to make engaging contact with a surface of the toilet bowl. The present invention further comprising at least one brush on a foldable arm coupled to the housing, wherein when activated, the brush is capable of extending from the housing into the toilet bowl to brush against a inner wall of the toilet bowl. The foldable arm has a longitudinal axis, and wherein at a resting position, the longitudinal axis is substantially horizontal.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting. To accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWING(S)

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
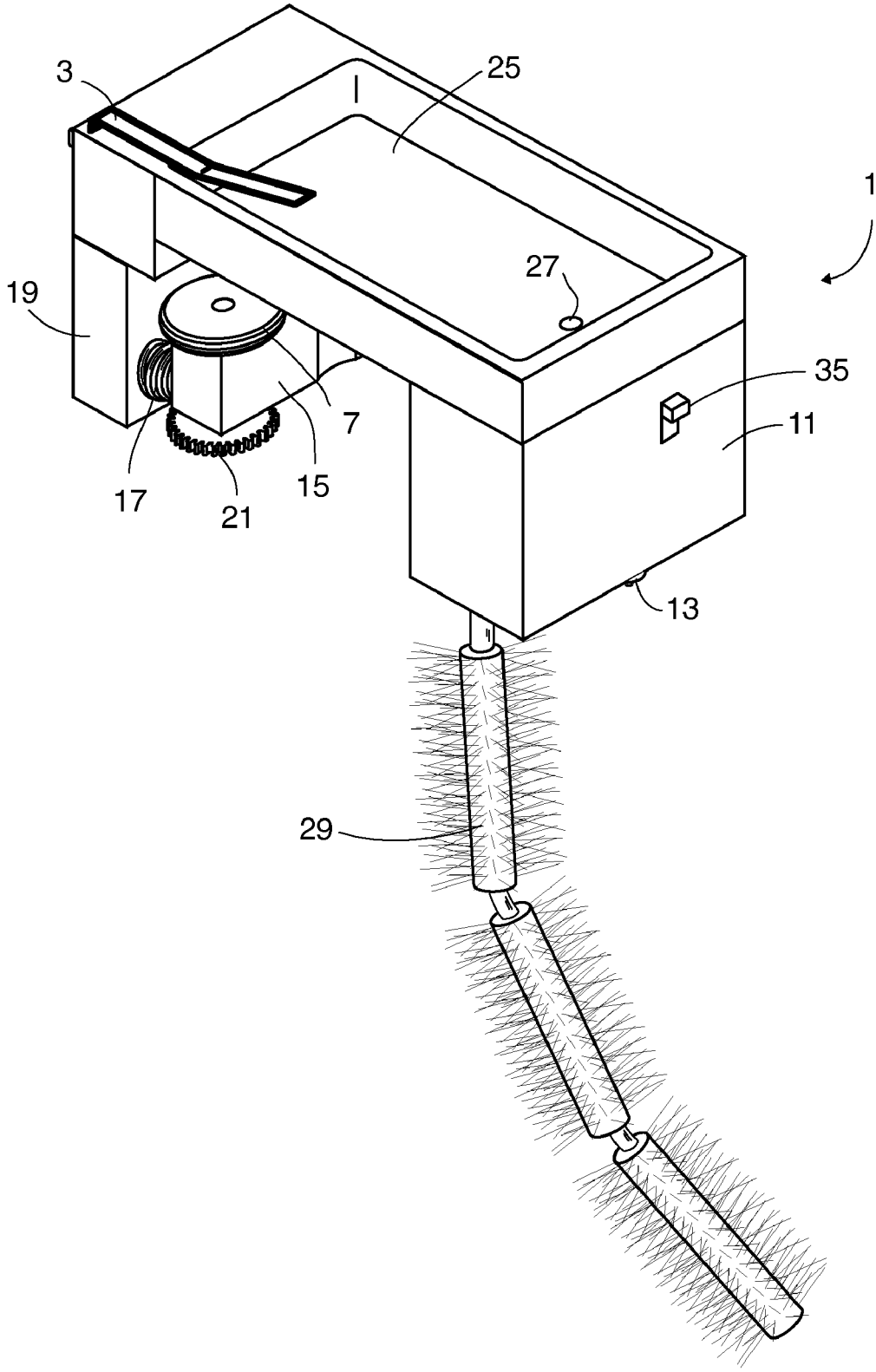
FIG. 1 is a front view of the motorized toilet bowl cleaning device attached to the toilet bowl rim.

Referring now to the drawings, which are provided by way of illustration and example, and wherein like reference numerals designate like or corresponding elements among the several views, there is shown in FIG. 1, the motorized toilet bowl cleaning device 1 shown attached to the toilet bowl rim. The present invention comprising a sensor 3, a left moving wheel 7, a container 11 capable of holding cleaning solution; a cleaning solution dispenser 13, a motor housing 15, at least one spring 17, a motor 19, at least one wheel gear 21, a recess 25 capable of receiving replaceable cleaning solution attachments; a cleaning solution outlet 27 and at least one brushing appendage 29 and a cleaning mode switch 35 that is capable of controlling the amount and rate of cleaning solution dispensation. Alternatively, other embodiments of the present invention may not require a recess 25 capable of receiving replaceable cleaning solution attachments and instead contain a lid or cover that would allow refilling of the container 11 with cleaning solution.

Figure 2:
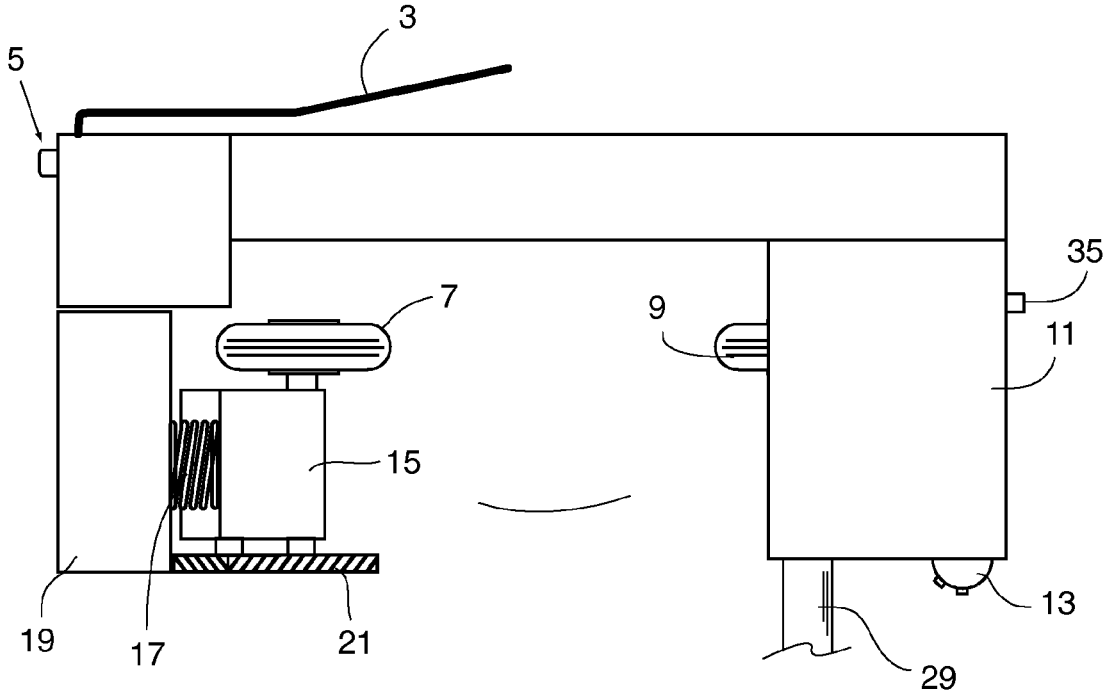
FIG. 2 is a front view of the motorized toilet bowl cleaning device.
Figure 3:
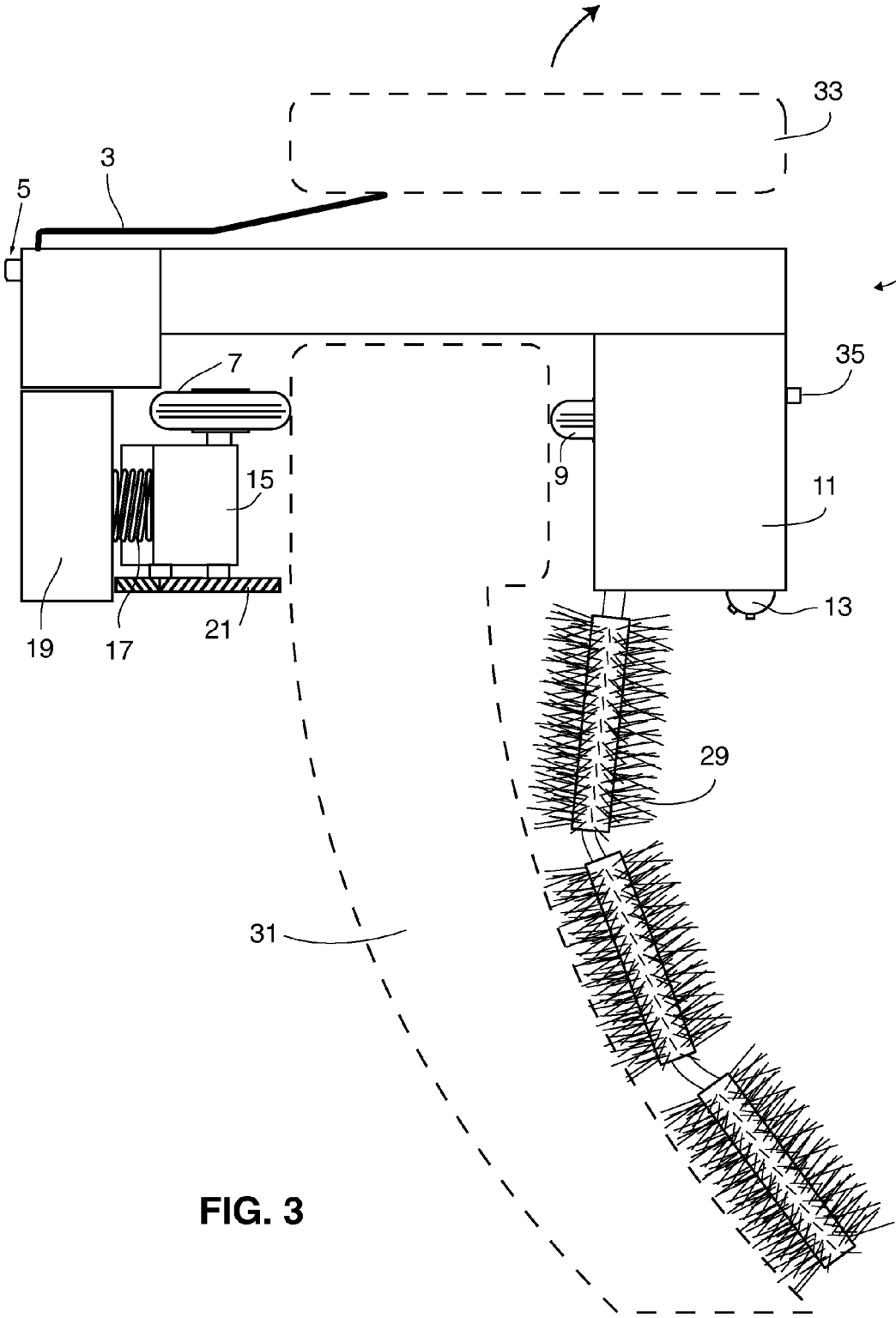
FIG. 3 is a left side view of the motorized toilet bowl cleaning device.

In typical use, the motorized toilet bowl cleaning device would be placed between on one-side of the toilet bowl rim. The present invention would be held in place by at least one moving wheel 7 and an opposing guide wheel 9 as shown in FIG. 2. The present invention has the ability to adjust to fit various sizes of current toilet bowl rims because of its use of the at least one tension spring 17 that provides flexibility and adjustability while positioning the present invention onto the toilet bowl rim. As clearly seen in FIG. 3, the motorized toilet bowl cleaning device 1 of the present invention is positioned onto the toilet bowl rim 31 whereas the toilet seat 33 is at its lowered position which rests onto the sensor 3. As the toilet bowl rim 31 is lifted up, the sensor 3 will turn on the motor 19, which will drive at least one wheel 7, which in turn will move the present invention along the length of the rim 31. The opposing guide wheel 9 allows the present invention to remain firmly attached to the toilet bowl rim 31 and to assist or guide the movement of the present invention along the length of the toilet rim 31. The opposing guide wheel 9 can either be an independent free-standing wheel or may be driven by another separate motor.

In one typical use, while the motorized toilet bowl cleaning device 1 in the present invention is moving along the rim 31 of the toilet bowl, the cleaning solution dispenser 13 periodically and at a pre-determined rate dispenses the cleaning solution in a variety of forms, such as a spray, stream or mist.

Figure 4:
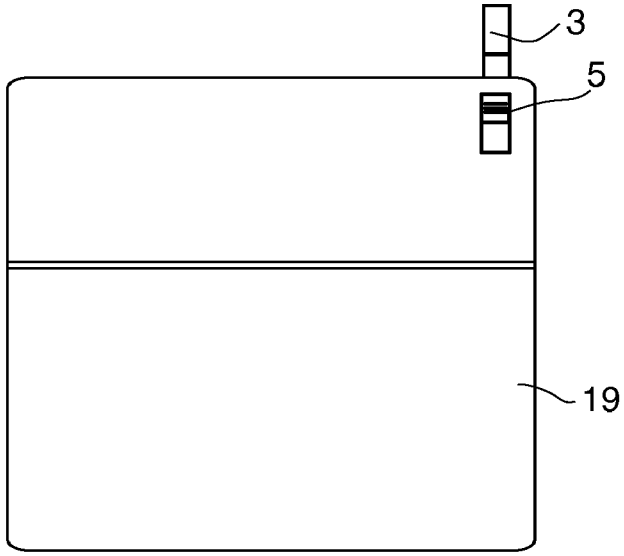
FIG. 4 is a right side view of the motorized toilet bowl cleaning device.
Figure 5:
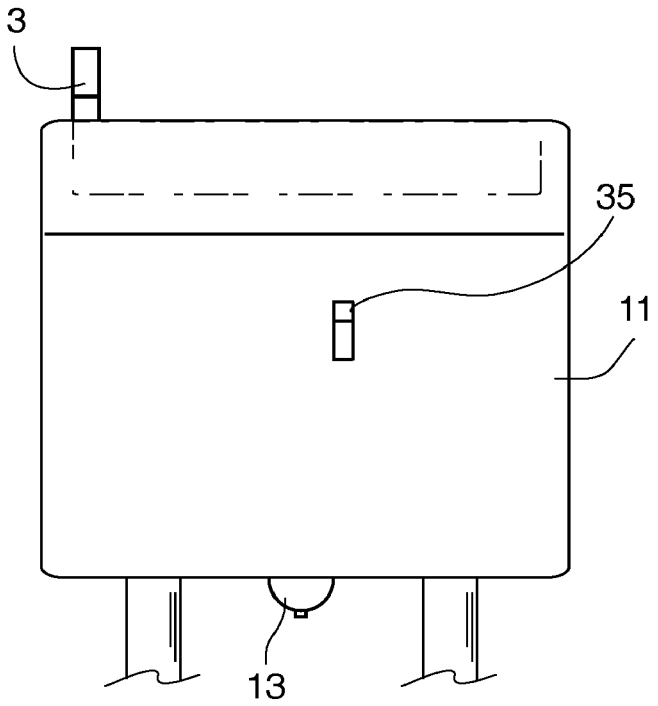
FIG. 5 is a top down view of the motorized toilet bowl cleaning device.

Further, at least one brushing appendage 29, which can be driven by the same motor 19 which drives the moving wheel 7 or another separate motor (not pictured), will at a pre-determined speed, begin to clean portions of the interior wall of the toilet bowl. In the currently preferred embodiment, the brushing appendage 29 moves in a side to side motion and circular motion, in order to effectively clean more surface area. In addition, in another contemplated embodiment, the brushing appendages 29 may be replaceable for sanitary concerns and to allow a variety of other sizes and shapes of brushing appendages to be attached to the present invention in order to clean different areas of the toilet bowl. FIG. 4 and FIG. 5 clearly shows the left and right sides of the motorized toilet bowl cleaning device and one possible arrangement of the power switch 5, the cleaning mode 35 switch and the sensor 3.

Figure 6:
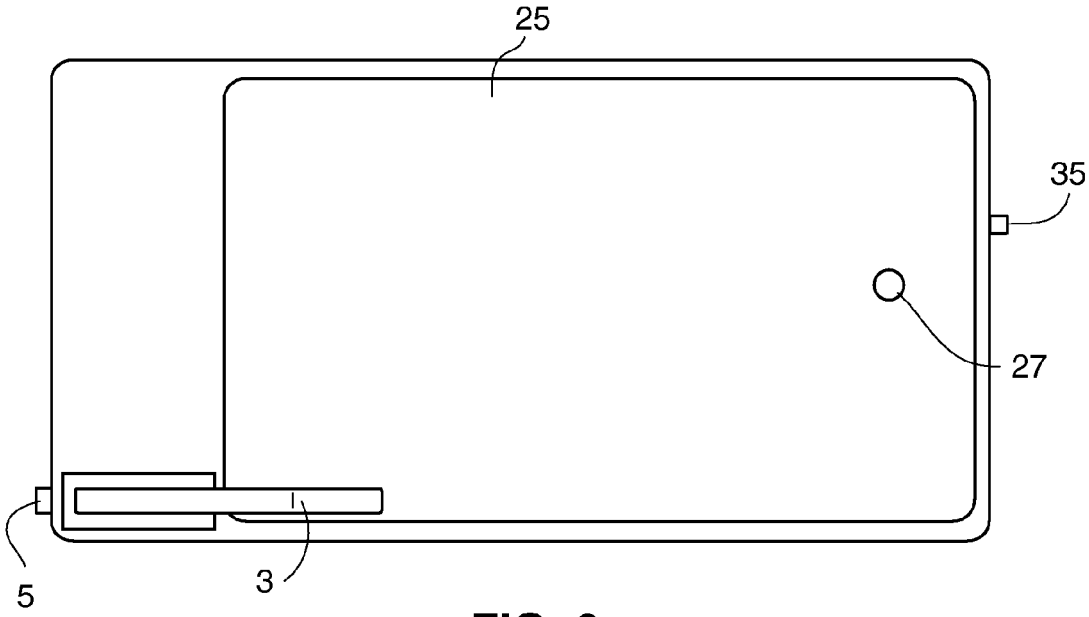
FIG. 6 is a bottom view of the motorized toilet bowl cleaning device.

As shown in FIG. 6, in the current preferred embodiment, the cleaning solution is contained in replaceable cartridges (not pictured) and that can be fitted flush in the recess 25 of the main top body of the present invention, which is also best seen in FIG. 1. Each of the replaceable cartridges has an opening which corresponds to the cleaning solution outlet 27 and allows the cleaning solution to transfer to the cleaning solution container 11, from where the cleaning solution dispenser 13 dispenses the solution onto the inner walls of the toilet bowl. Alternatively, the present invention may contain a lid or an opening in the container 11 that would allow the container 11 to be refilled with cleaning solution.

Figure 7:
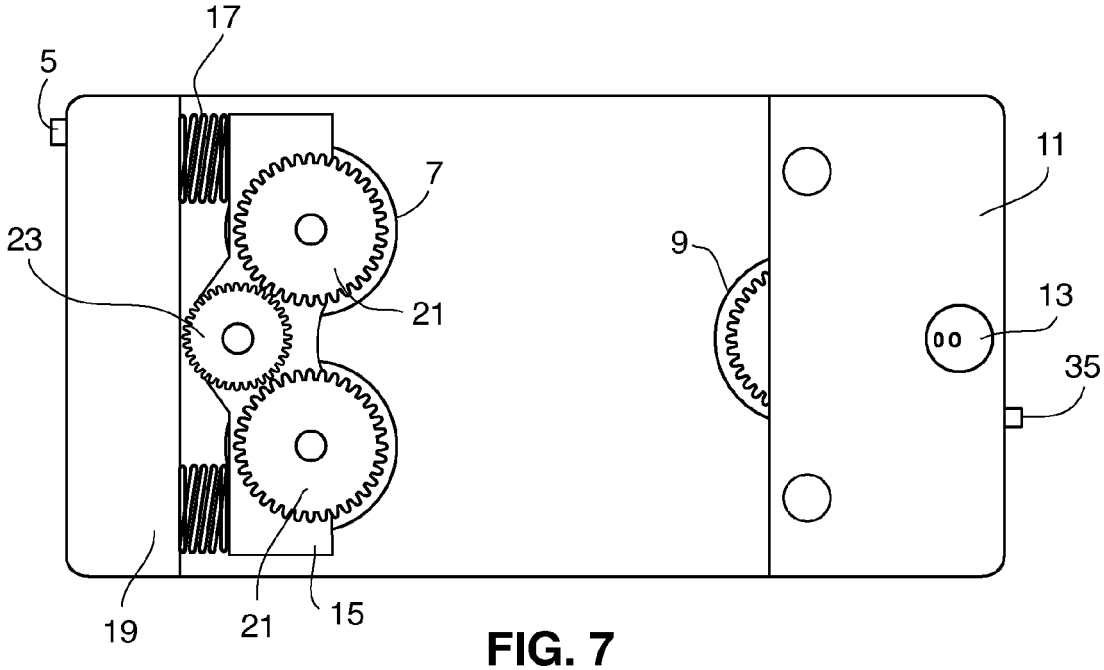
FIG. 7 is a 45 degree top down perspective view of the motorized toilet bowl cleaning device.
Figure 8:
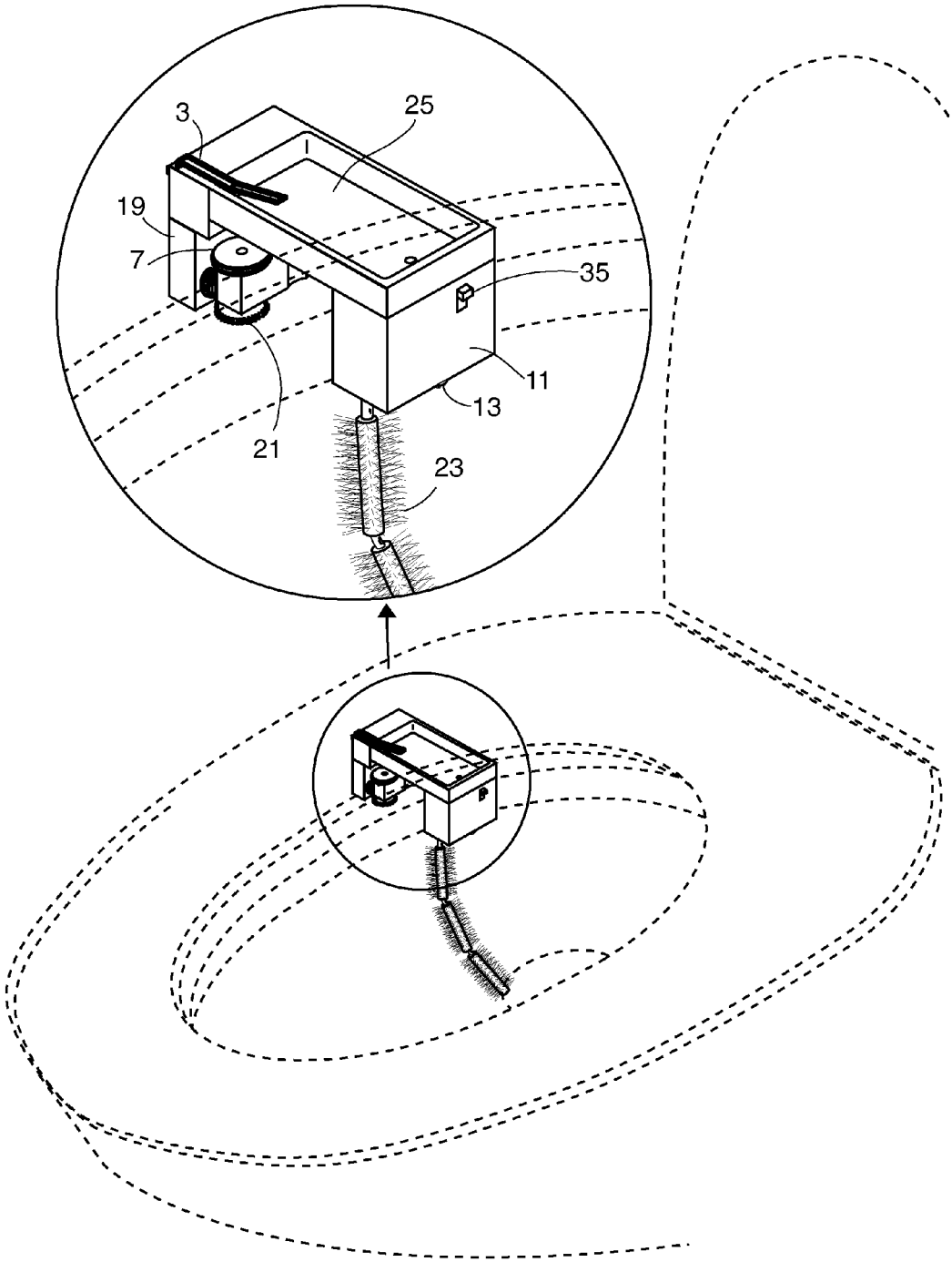
FIG. 8 is a 45 degree top down perspective view of the motorized toilet bowl cleaning device attached to the toilet bowl rim after toilet seat cover is lowered down to contact first sensor of the present invention.

In order for the present invention's toilet bowl cleaner to be motorized, it incorporates the use of a motor, motor gear, wheel gears and wheels to allow the present invention to move along the length of the toilet bowl rim without manual assistance. In an alternative embodiment, the present invention utilizes flexible rubber bands, straps or strips in replace or in conjunction with the wheel gears. FIG. 7 clearly depicts at least one moving wheel 7, which is driven by at least one wheel gear 21, which is driven by at least one motor gear 23. In another preferred embodiment, another motor gear, and wheel gear may be included to drive the opposing guide wheel 9 in unison with the primary moving wheel 7 and motor gear 23. FIG. 8 illustrates the present invention as normally positioned on the toilet bowl rim 31 underneath the toilet seat cover.

Thus, specific embodiments and applications of the motorized toilet bowl cleaner have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A motorized toilet bowl cleaning device, the device comprising:

a main body having a frame that attaches to a rim of a toilet bowl;

a container coupled to the main body capable of holding a cleaning solution;

a dispenser coupled to the container to spray the cleaning solution, wherein when the main body is attached to the rim of the toilet bowl, the dispenser is positioned and angled to spray the cleaning solution onto an inside wall of the toilet bowl;

at least one brush on a movable, foldable arm positioned to brush the inside wall of the toilet bowl, wherein the movable, foldable arm is coupled to the main body;

an electric motor coupled to the main body;

a power source for powering the electric motor;

at least one moving wheel driven by the electric motor such that when the main body is attached to the rim of the toilet bowl, the wheel is in engaging contact with an outer side surface of the rim, wherein the moving wheel is capable of rolling along the rim to move the device along a length of the rim;

an opposing guiding wheel contacting an inner side surface of the rim when the main body is attached to the rim of the toilet bowl, wherein the opposing guiding wheel together with the moving wheel allowing the cleaning device to remain firmly attached to the toilet bowl rim and guiding the rolling movement of the cleaning device along the length of the rim; and a timing means for setting a pre-determined amount of time to run the electric motor, causing the cleaning device to travel and roll along the rim of the toilet bowl for the pre-determined amount of time when the motor is activated by a first sensor.

2. The device as recited in claim 1 wherein the first sensor is for sensing whether the toilet seat is in a down position.

3. The device as recited in claim 2 wherein when the first sensor senses that the toilet seat is in at least one of down position or up position, the first sensor causes the motor to turn on to drive the wheel.

4. The device as recited in claim 1, wherein the wheel is capable of rolling along the rim to move the device along at least 50% of the entire circumference of the rim.

5. The device as recited in claim 4, wherein the wheel is capable of rolling along the rim. to move the device along at least 70% of the entire circumference of the rim.

6. The device as recited in claim 4 further comprising a second sensor for sensing stopping point to stop further traveling of the device along the rim, and to cause shutting off of the motor.

7. The device as recited in claim 4, wherein the dispenser includes a nozzle, and the spraying is driven by at least one of electric pump, pressurized gas, pressurized liquid, and timed-release aerosol sprayer.

8. The device as recited in claim 7, wherein the power source is at least one member selected from the group consisting of a rechargeable battery pack, a disposable battery, and A/C current.

9. The device as recited in claim 7 further comprising a user-actuated switch allowing a user to selectively activate the nozzle for spraying cleaning solution onto the inside wall of the toilet bowl.

10. The device as recited in claim 7 further comprising an electric circuit that turns on the nozzle at pre-determined time intervals.

11. The device as recited in claim 1, wherein the movable, foldable arm has a longitudinal axis, and wherein at a resting position, the longitudinal axis is substantially horizontal.

* * * * *